US005725088A

United States Patent [19]

Aimi

[11] Patent Number: 5,725,088

[45] Date of Patent: Mar. 10, 1998

[54] SWITCH FOR USE IN ELECTRONIC DEVICES

[75] Inventor: Mitsuo Aimi, Osaka, Japan

[73] Assignee: Matsushita Electric Industrial Co., Ltd., Japan

[21] Appl. No.: 644,051

[22] Filed: May 10, 1996

[30] Foreign Application Priority Data

May 17, 1995 [JP] Japan ..... 7-118174

[51] Int. Cl.[6] ..... H01H 15/06

[52] U.S. Cl. ..... 200/542; 200/538; 200/537

[58] Field of Search ..... 200/533, 551, 200/408, 542, 554, 557, 558, 559, 244, 547, 537, 538

[56] References Cited

U.S. PATENT DOCUMENTS

| | | | |
|---|---|---|---|
| 3,413,430 | 11/1968 | Sharples | 200/559 |
| 3,482,067 | 12/1969 | Sanford | 200/553 |
| 3,800,260 | 3/1974 | Woodger . | |
| 4,104,494 | 8/1978 | Swann . | |
| 4,145,586 | 3/1979 | Swann . | |
| 4,147,908 | 4/1979 | Swann . | |
| 4,170,725 | 10/1979 | Farrell . | |
| 4,204,102 | 5/1980 | Bull . | |
| 4,259,552 | 3/1981 | Swann . | |
| 4,562,318 | 12/1985 | Sorenson . | |
| 4,740,661 | 4/1988 | Nishikawa et al. . | |
| 5,051,552 | 9/1991 | Hou et al. . | |
| 5,329,163 | 7/1994 | Satoh et al. | 200/553 |
| 5,397,870 | 3/1995 | Noro . | |

FOREIGN PATENT DOCUMENTS

| | | |
|---|---|---|
| 1081383 | 8/1967 | United Kingdom . |

*Primary Examiner*—David J. Walczak
*Attorney, Agent, or Firm*—Parkhurst, Wendel & Burr, L.L.P.

[57] ABSTRACT

A stationary terminal 12 and a common terminal 13 are provided on a bottom of an insulating case 11. A pivot 14*a* is provided on an upper end of common terminal 13. A change-over plate 14 is rotatable about and brought into contact with the pivot 14*a*. A projection 16*a*, provided under slider 16, is brought into contact with and slidable along a sliding surface 14*g* of change-over plate 14 at a position lower than the pivot 14*a*. Change-over plate 14 causes a seesaw movement about the pivot 14*a*, and quickly accomplishes the switching movement regardless of the shifting speed of slider 16. Thus, it becomes possible to provide a switch which is highly reliable and free from burnout and welding of the contacts.

8 Claims, 8 Drawing Sheets

SWITCH FOR USE IN ELECTRONIC DEVICES

BACKGROUND OF THE INVENTION

1. Field of the Invention

This invention generally relates to a switch preferably used in various electronic devices.

2. Prior Art

FIGS. 11, 12A and 12B show a conventional switch. FIG. 11 is a cross-sectional side view showing the conventional switch. In the drawing, an insulating case 1 is formed into a box-like shape having a bottom and four side walls. A stationary terminal 2 and a common terminal 3 are inserted across the bottom of insulating case 1, and are fixed on the bottom of insulating case 1.

A change-over plate 4 is supported on common terminal 3 at its central engaging point 4*a* and is rotatable about the upper end 3*a* of common terminal 3. A leaf spring 5, provided on the change-over plate 4 so as to extend in the longitudinal direction, connects opposite ends 4*b* and 4*c* of change-over plate 4.

A slider 6, having a projection 6*a* protruding downward from its main body, slides on the upper surface of leaf spring 5, while giving a pressing force to leaf spring 5 in accordance with its slide movement.

Slider 6 is slidable along a lower flat surface of frame 7. Frame 7, serving as a cover of insulating case 1, closes the upper opening of insulating case 1 so as to accommodate slider 6, terminals 2, 3 and change-over plate 4 therein.

Operation of the above-described conventional switch is explained next.

FIG. 12A shows a condition where the switch is turned off. When slider 6 is shifted left from this condition, slider 6 comes to a point were projection 6*a* of slider just reaches the center of leaf spring 5 as shown in FIG. 12B. Change-over plate 4 starts rotating in the counterclockwise direction.

In such a movement, the moving speed of change-over plate 4 virtually depends on the speed of slider 6.

A contact point 6*b* between protrusion 6*a* of slider 6 and leaf spring 5 is positioned just above a rotational center 4*a* of change-over plate 4. Such a positional relationship forces protrusion 6*a* of slider 6 to interfere with the rotation of change-over plate 4 when change-over plate 4 rotates about rotational center 4*a* in the counterclockwise direction. This is why the moving speed of change-over plate 4 is virtually affected by the moving speed of slider 6.

When slider 6 moves slowly, the rotational movement of change-over plate 4 is delayed correspondingly. An arc is generally caused momentarily in a short gap formed between contacts 2*a* and 4*d* when the switch is turned on or off. Such an arc will last long if change-over plate 4 moves slowly. A long-lasting arc can cause burnout or welding between contacts 2*a* and 4*d* due to Joule heat, leading to the deterioration and thus reliability.

SUMMARY OF THE INVENTION

Accordingly, in view of above-described problems encountered in the prior art, a principal object of the present invention is to provide a switch having excellent operating and reliability properties.

In order to accomplish this and other related objects, the present invention provides a novel switch comprising: an insulating case having a common terminal and a stationary terminal which are provided on a bottom thereof, the common terminal having a recessed pivot on an upper end thereof while the stationary terminal having a contact; a change-over plate having a flat sliding surface and an engaging portion engaged with the pivot of the common terminal, disposed in such a manner that the engaging portion is positioned above the flat sliding surface, the change-over plate being rotatable about the pivot of the common terminal; a slider having a projecting slide portion brought into contact with the flat sliding surface of the change-over plate, disposed in such a manner that the slider can slide along the sliding surface; and a frame covering an upper opening of the insulating case so as to accommodate the change-over plate and the slider therein, wherein the change-over plate is rotated about the pivot of the common terminal when the slider slides along the sliding surface, bringing a contact provided on one end of the change-over plate into contact with the contact of the stationary terminal.

According to features of preferred embodiments of the present invention, the change-over plate is made of a resilient metallic member, and the engaging portion is a tonguelet provided at a center of the change-over plate, and a distal end of the tonguelet is engaged with and rotatable about the recessed pivot provided on the upper end of the common terminal. The change-over plate is formed into a configuration with a bottom and two side walls forming a rectangular cross section, and the tonguelet extends between two parallel sliding surfaces elongated along upper ends of the two side walls.

Still further, according to the features of the preferred embodiments of the present invention, the flat sliding surface provided on the change-over plate is partly inclined or curved.

Yet further, it is preferable that the change-over plate is made of a leaf spring, the engaging portion is formed at a middle of the change-over plate so as to be engageable with and rotatable about the upper end of the common terminal, a hole is opened at a center of the change-over plate, one end of the change-over plate is folded in an U-shaped configuration so that a distal end thereof is inserted into the hole, and an upper surface of the distal end serves as the sliding surface.

Alternatively, it is preferable that the change-over plate is made of a leaf spring and is folded in an U-shaped configuration, a contact is fixed on one end of the change-over plate, and the other end of the change-over plate is engaged with and rotatable about the upper end of the common terminal.

With the arrangement of the present invention, the pivot of the change-over plate is located at a position higher than the sliding surface of the change-over plate. Such an arrangement makes it possible to quicken the rotation of the change-over plate about the pivot, eliminating unnecessary contact at the contact point while improving the reliability of the switch.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1A:
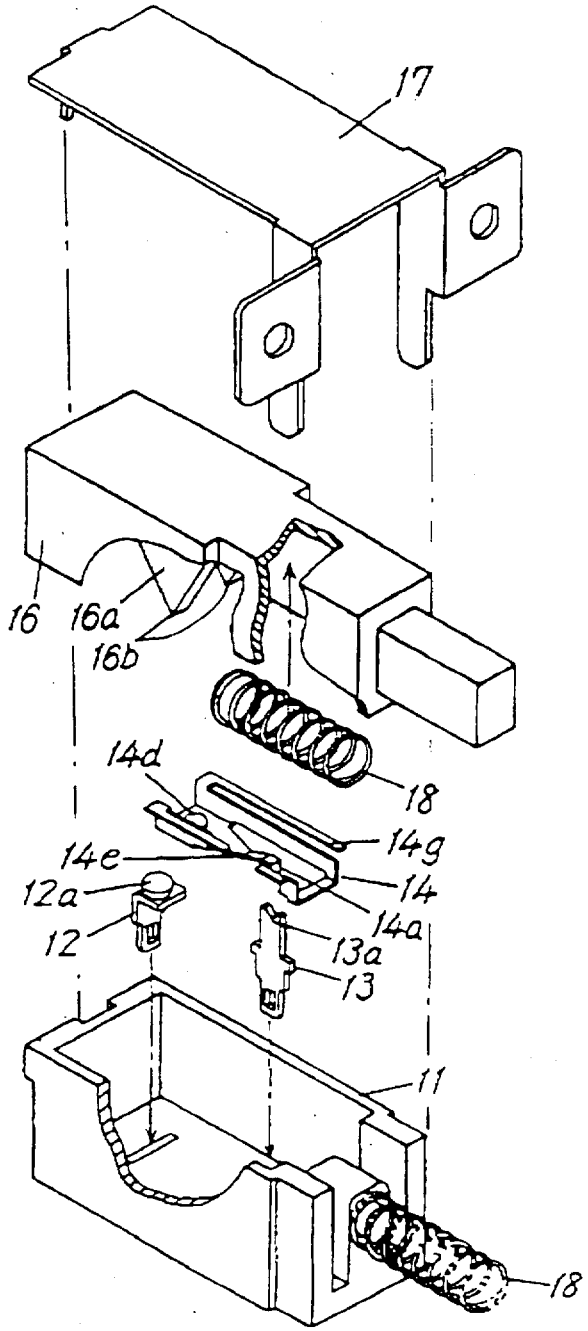
FIG. 1A is a partly-sectional, exploded, perspective view showing a switch in accordance with a first embodiment of the present invention.

Preferred embodiments of the present invention will be explained in greater detail hereinafter, with reference to the accompanying drawings. In the drawings, identical parts are denoted by an identical reference numeral.

First Embodiment

FIG. 1A is a partly-sectional, exploded, perspective view showing a switch in accordance with a first embodiment of the present invention.

In the drawing, an insulating case 11 is formed into a box-like shape having a bottom and four side walls. A stationary terminal 12 and a common terminal 13 are respectively inserted across the bottom of insulating case 11, and are fixed on the bottom of insulating case 11. A contact **12*a* is fixed on the top of stationary terminal 12**.

A change-over plate 14, made of a resilient metallic member, is formed into substantially the rectangular cross-sectional shape having a bottom **14*b* and two opposed side walls 14*f*** extending in the longitudinal direction thereof.

Figure 1B:
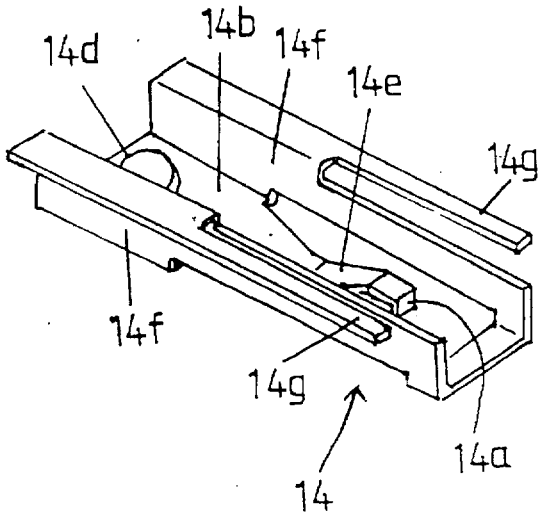
FIG. 1B is a perspective view enlargedly showing a change-over plate shown in FIG. 1A.

FIG. 1B shows the details of change-over plate 14. A contact **14*d* is fixed on one end of the bottom 14*b* of change-over plate 14. Each side wall 14*f* is bent outward at the top end thereof, so as to form a sliding surface 14*g* extending in the longitudinal direction of the change-over plate 14. Each sliding surface 14*g* is separated from the side wall 14*f*** at its distal end, so as to constitute a resiliently deformable portion.

A cantilever plate **14*e* is provided on the bottom 14*b* at a lateral center thereof so as to extend from a portion near contact 14*d* toward the opposite end through a gap between two sliding surfaces 14*g*. Cantilever plate 14*e* is curved upward like a tonguelet, and is bent downward at a distal end thereof so as to form a pivot 14*a* which is engageable with a recessed pivot 13*a* formed on the top of common terminal 13**.

A slider 16 has a pair of parallel projection **16*a* protruding downward from its main body. Parallel projections 16*a* are spaced from each other at a distance equivalent to the gap between two sliding surfaces 14*g* formed at the upper end of side walls 14*f*. A sliding point 16*b*, formed at the lower edge of each projection 16*a*, is brought into contact with and slidable along a corresponding one of sliding surfaces 14*g* of the change-over plate 14**.

A coil spring 18 is incorporated in slider 16 to urge slider 16 in one direction. A frame 17, serving as a cover of insulating case 11, closes the upper opening of insulating case 11 so as to accommodate slider 16, terminals 12, 13 and change-over plate 14 therein.

Figure 2A:
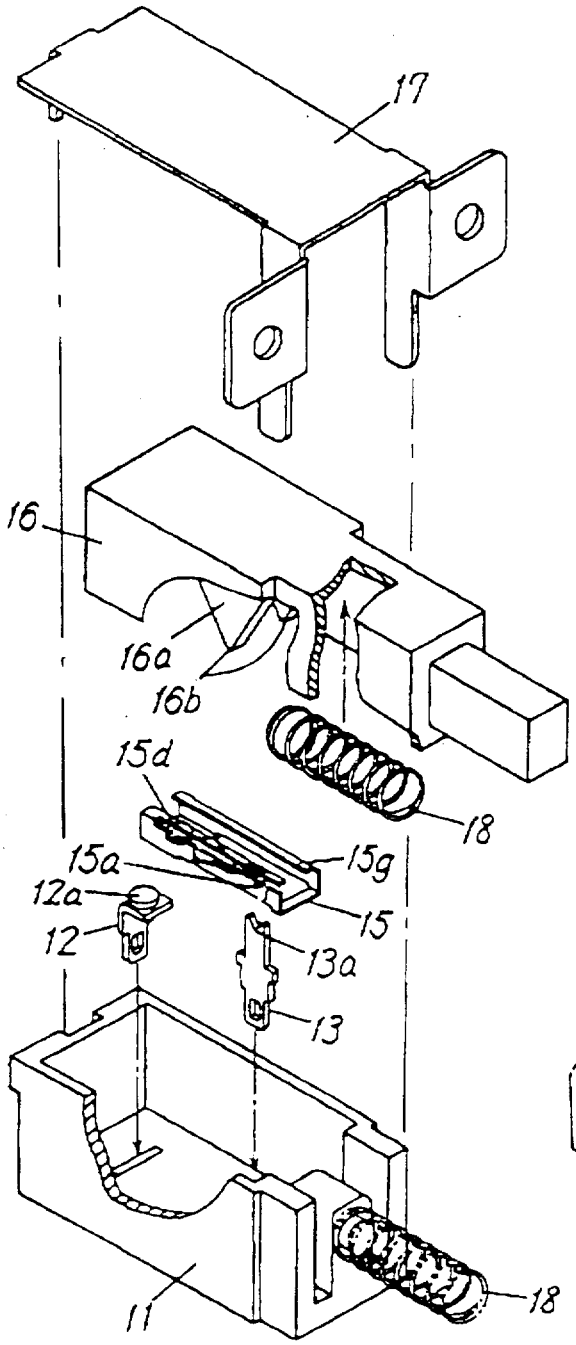
FIG. 2A is a partly-sectional, exploded, perspective view showing a modification of the switch in accordance with the first embodiment of the present invention.

FIG. 2A is a partly-sectional, exploded, perspective view showing a modification of the switch in accordance with the first embodiment of the present invention. The switch shown in FIG. 2 is different from the switch shown in FIG. 1 in the configuration of the change-over plate.

More specifically, a change-over plate 15, made of a resilient metallic member, is formed into substantially the rectangular cross-sectional shape having a bottom **15*b* and two opposed side walls 15*f*** extending in the longitudinal direction thereof.

Figure 2B:
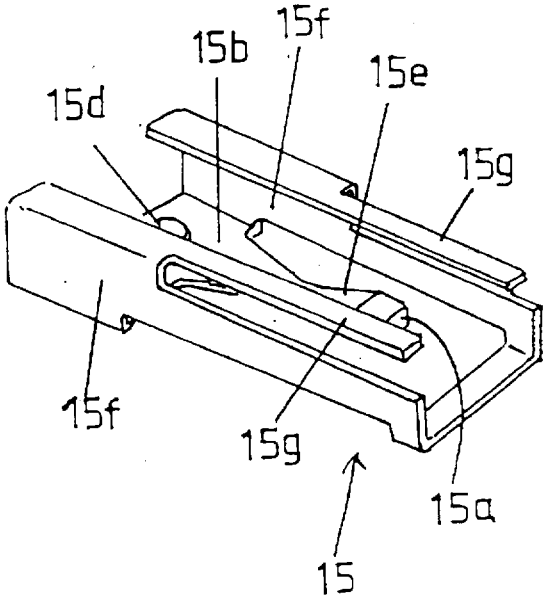
FIG. 2B is a perspective view enlargedly showing a change-over plate shown in FIG. 2A.
Figure 3:
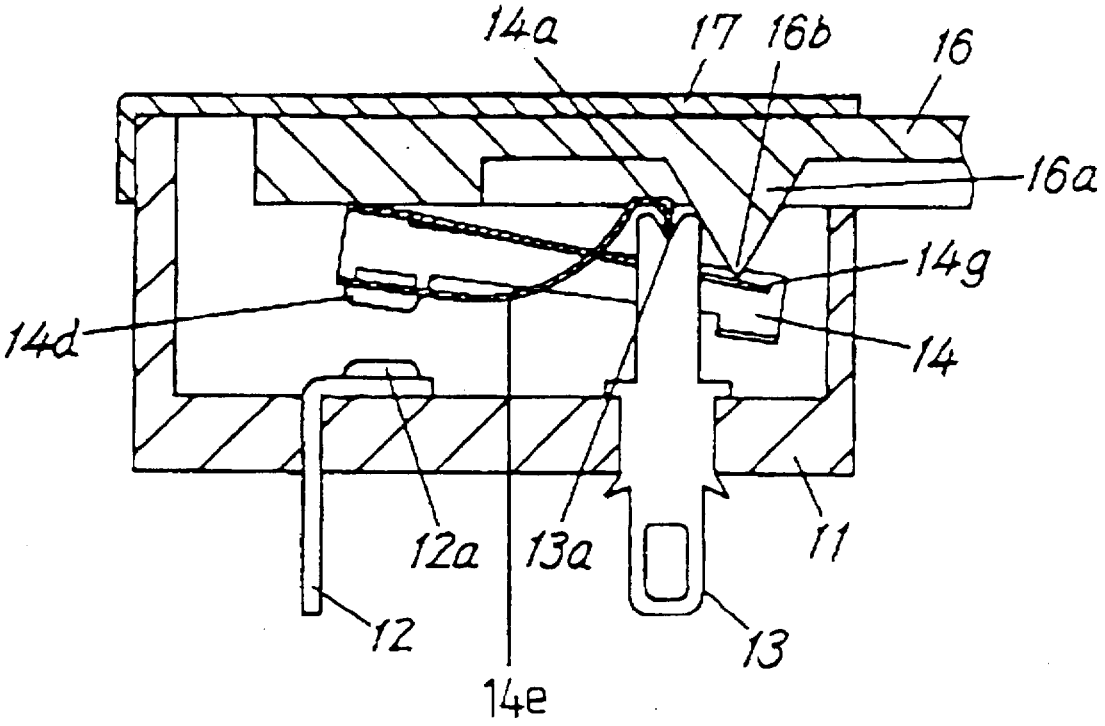
FIG. 3 is a cross-sectional view showing an essential arrangement of the switch in accordance with the first embodiment of the present invention.

FIG. 2B shows the details of change-over plate 15. A contact **15*d* is fixed on one end of the bottom 15*b* of change-over plate 15. Change-over plate 15 is different from change-over plate 14 of FIGS. 1A and 1B in that each side wall 15*f* is bent inward at the top end thereof, so as to form a sliding surface 15*g* extending in the longitudinal direction of the change-over plate 15. Each sliding surface 15*g* is separated from the side wall 15*f*** at its distal end, so as to constitute a resiliently deformable portion.

A cantilever plate **15*e* is provided on the bottom 15*b* at a lateral center thereof so as to extend from a portion near contact 15*d* toward the opposite end through a gap between two sliding surfaces 15*g*. Cantilever plate 15*e* is curved upward like a tonguelet, and is bent downward at a distal end thereof so as to form a pivot 15*a* which is engageable with recessed pivot 13*a* formed on the top of common terminal 13**.

Operation of the above-described switch in accordance with the first embodiment of the present invention is explained next, with reference to FIGS. 3, 4A, 4B and 4C.

Figure 4A:
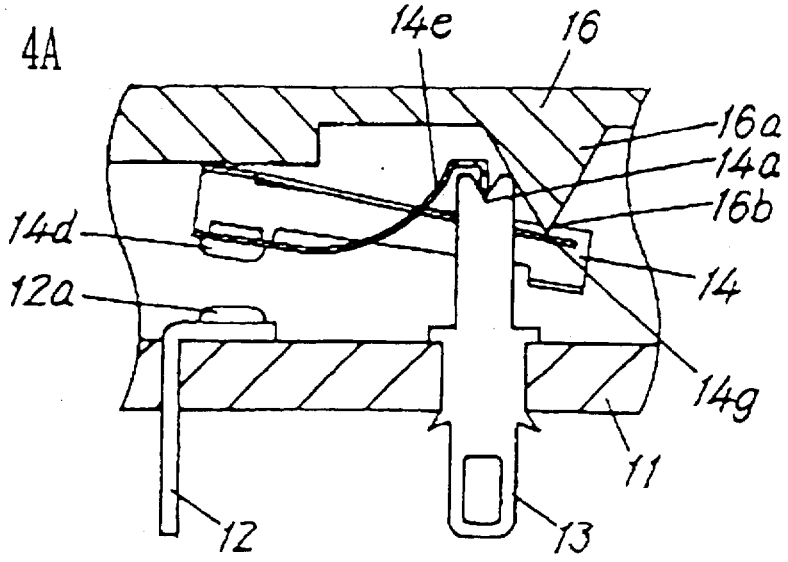
FIG. 4A is a cross-sectional view showing a condition where the switch is in an OFF condition in accordance with the first embodiment of the present invention.
Figure 4B:
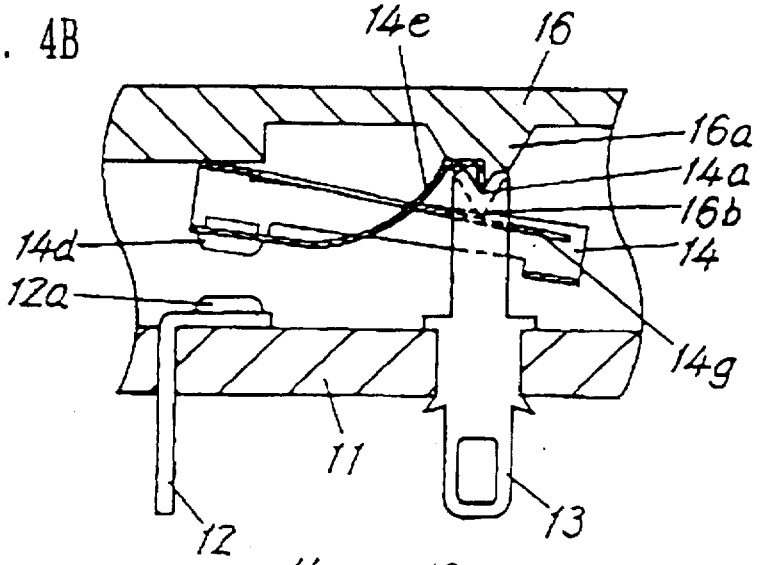
FIG. 4B is a cross-sectional view showing a condition immediately before the switch is turned on in accordance with the first embodiment of the present invention.
Figure 4C:
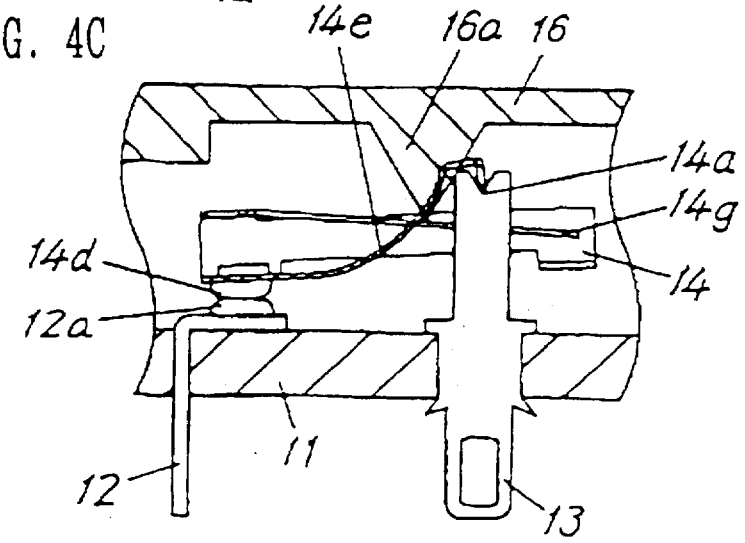
FIG. 4C is a cross-sectional view showing a condition where the switch is in an ON condition in accordance with the first embodiment of the present invention.

FIG. 4A shows an OFF condition of the switch. When slider 16 is shifted left from this condition, sliding point **16*b* of slider 16 gradually depresses sliding surface 14*g* of change-over plate 14 downward agaist a reaction force of the resiliently deformable distal end of sliding surface 14*g*. As shown in FIG. 4B, sliding point 16*b* of slider 16 is moved to a position lower than the pivot 14*a* of change-over plate 14. When sider 16 is further shifted in the same direction (i.e. the left direction), change-over plate 14 causes a rotation in the counterclockwise direction. Thus, contact 14d fixed on the one end of the bottom 14bb of change-over plate 14 is brought into contact with contact 12a of stationary terminal 12 provided on the bottom of insulating case 11 as shown in FIG. 4C**, thereby establishing an ON condition of the switch.

Change-over plate 14 does not start a rotation in the counterclockwise direction at the moment the sliding point 16b of slider 16 is positioned just below the pivot 14a or at the moment the sliding point 16b has slightly passed the pivot 14a, as shown in FIG. 4B.

Such a characteristic movement of change-over plate 14 will be explained in greater detail hereinafter with reference to FIG. 5.

Figure 5:
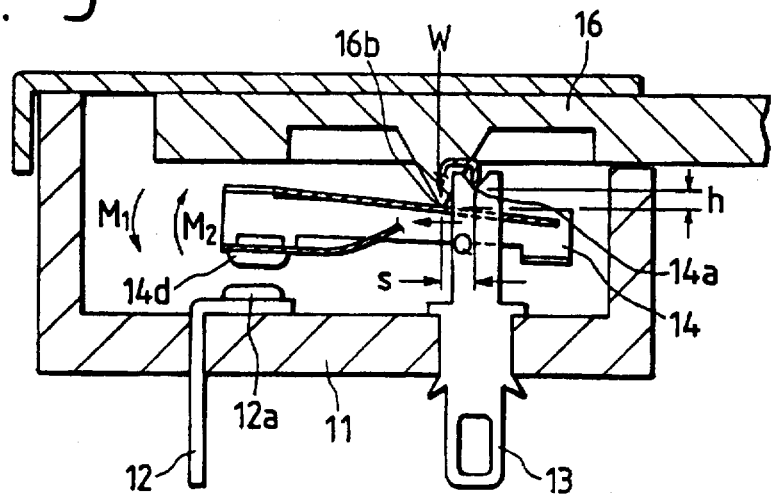
FIG. 5 is a view illustrating a momental relationship between the change-over plate and the slider in the condition immediately before the switch is turned on in accordance with the first embodiment of the present invention.

In FIG. 5, "W" represents a force acting from slider 16 to change-over plate 14. "S" represents a distance between pivot 14a of change-over plate 14 and sliding point 16b of slider 16 in the sliding direction of slider 16. Meanwhile, "h" represents a distance between pivot 14a of change-over plate 14 and sliding point 16b of slider 16 in the vertical direction.

Moment M1, acting on change-over plate 14 from slider 16 shifting in the left direction for causing a rotation in the counterclockwise direction, is expressed in the following manner.

$$M1=W\times S \quad (1)$$

On the contrary, a force "Q" resisting this force, is expressed in the following manner.

$$Q=W\times\mu \quad (2)$$

where "μ" represents a friction coefficienct of sliding point 16b.

Accordingly, moment M2, acting on change-over plate 14 for causing a rotation in the clockwise direction, is expressed in the following manner.

$$M2=Q\times h \quad (3)$$

As apparent from the above relationship defined by equations (1) through (3), change-over plate 14 does not cause a rotation when moment M2 is larger than moment M1 (i.e. M1<M2). On the contrary, change-over plate 14 causes a rotation in the counterclockwise direction and turns on the switch when moment M1 is larger than moment M2 (i.e. M1>M2).

Once the moment M1 exceeds the other moment M2, an angle of sliding point 16b of slider 16 with respect to the sliding surface 14g of change-over plate 14 is varied so as to facilitate the sliding movement of slider 16, thereby accelerating the rotation of change-over plate 14.

In this manner, the first embodiment of the present invention does not allow change-over plate 14 to cause a rotation at the moment immediately after sliding point 16b of slider 16 has just passed pivot 14a of change-over plate 14, while storing a resilent force until the moment M1 exceeds the moment M2. Then, change-over plate 14 quickly starts rotating as soon as the moment M1 exceeds the moment M2. Such a quick switching operation is equally performed in both of turning-on and turning-off operations of the switch.

Hence, in both of turning-on and turning-off operations of the switch, change-over plate 14 is stably and quickly operated even if slider 16 is moved slowly.

Second Embodiment

Figure 6:
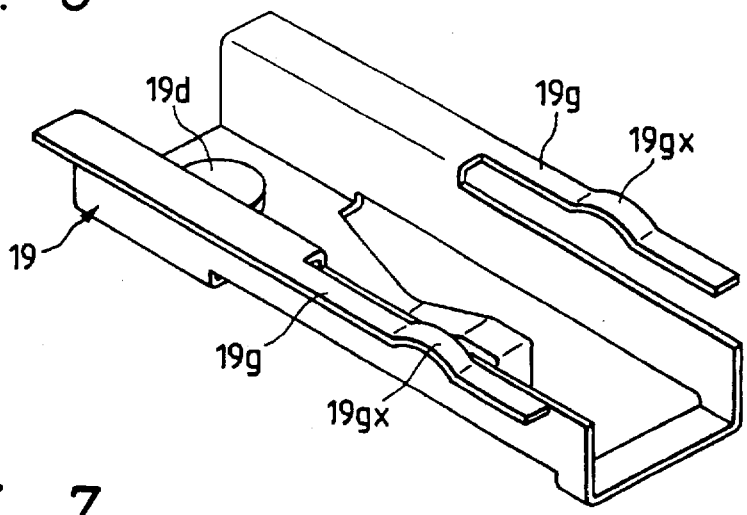
FIG. 6 is a perspective view showing a change-over plate of a switch in accordance with a second embodiment of the present invention.

FIG. 6 shows a change-over plate of a switch in accordance with a second embodiemnt of the present invention.

The second embodiment is different from the above-described first embodiment in the configuration of the change-over plate.

As shown in FIG. 6, a change-over plate 19 has a sliding surface 19g which is partly curved to form a swell 19gx. When slider 16 slides on sliding surface 19g of change-over plate 19 to rotate the change-over plate 19, the swell 19gx formed on sliding surface 19g acts as a means for quickening the switching operation of change-over plate 19.

Furthermore, the swell 19gx formed on sliding surface 19g has a function of forcibly separating the contacts 12a and 19d in the event of welding. When change-over plate 19 is swung about common terminal 13 during the above-described operation, the swell 19gx formed on sliding surface 19g causes a large up-and-down movement of the opposite end of change-over plate 19, giving a large force for separating the welded contacts.

Except for the above-described feature, change-over plate 19 is identical to the change-over plate 14 of the first embodiment.

Third Embodiment

Figure 7:
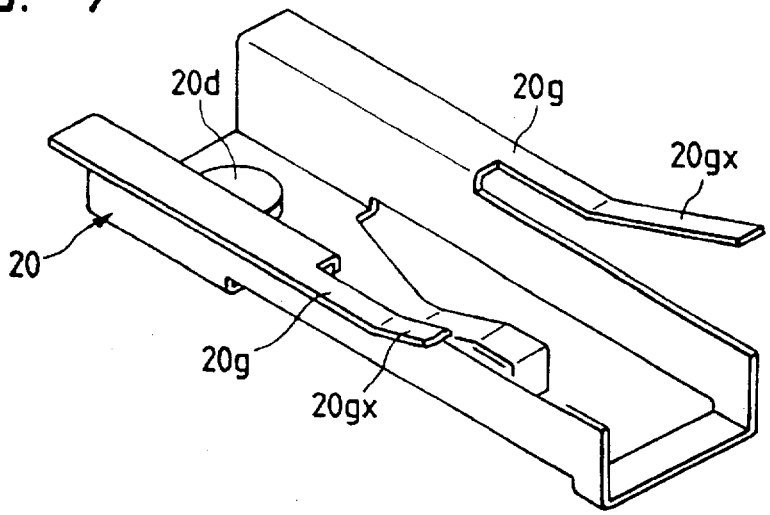
FIG. 7 is a perspective view showing a change-over plate of a switch in accordance with a third embodiment of the present invention.

FIG. 7 shows a change-over plate of a switch in accordance with a third embodiemnt of the present invention.

The third embodiment is different from the above-described first embodiment in the configuration of the change-over plate.

As shown in FIG. 7, a change-over plate 20 has a sliding surface 20g which is partly inclined to form a slope 20gx. This slope 20gx acts in the same manner as the swell 19gx of the above-described second embodiemnt in the event of welding of the contacts 12a and 20d. Except for this feature, change-over plate 19 is identical to the change-over plate 14 of the first embodiment.

Fourth Embodiment

Figure 8:
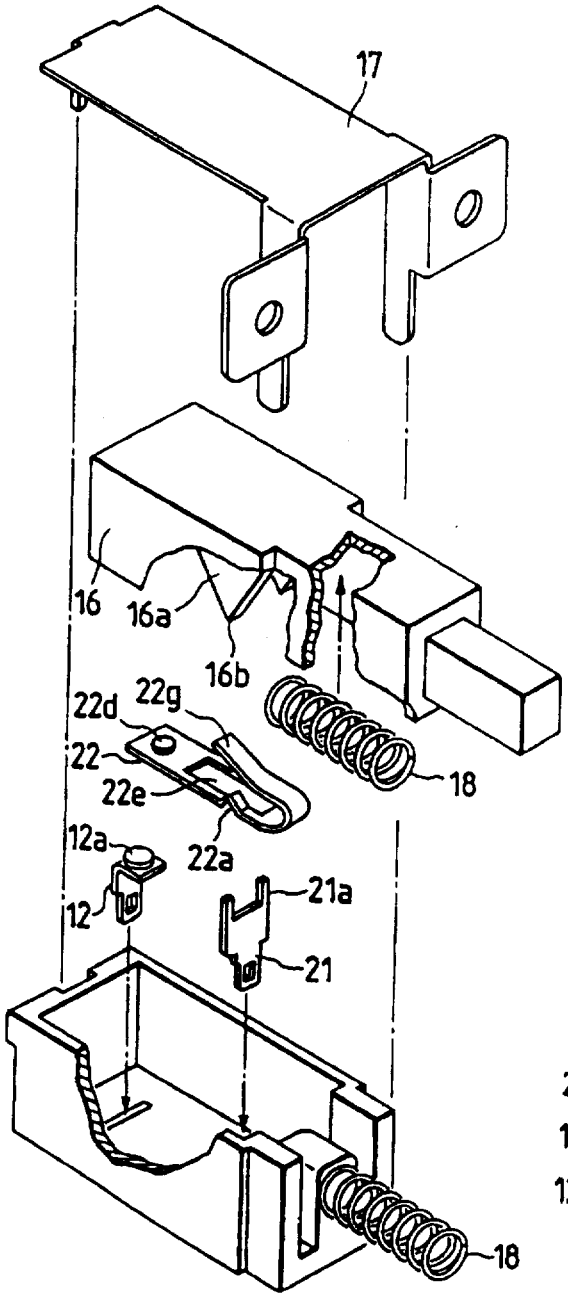
FIG. 8 is a partly-sectional, exploded, perspective view showing a switch in accordance with a fourth embodiment of the present invention.
Figure 9:
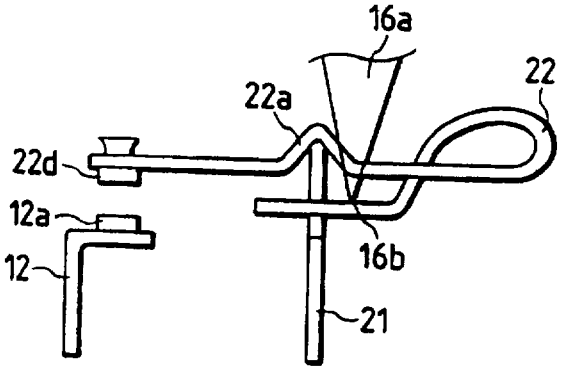
FIG. 9 is an enlarged view showing a change-over plate and a common terminal shown in FIG. 8.

FIG. 8 is a partly-sectional, exploded, perspective view showing a switch in accordance with a fourth embodiment of the present invention. FIG. 9 is an enlarged view showing a change-over plate 22 and a common terminal 21 shown in FIG. 8. Change-over plate 22, made of a leaf spring, has an engaging portion 22a formed at a middle thereof. Engaging portion 22a is engageable with a bifurcated upper end 21a of common terminal 21. Change-over plate 22 has an elongated hole 22e opened at the center thereof near engaging portion 22a. A contact 22d is provided on one end of change-over plate 22. The other end of change-over plate 22 is folded upward in an U-shaped configuration, with a distal end inserted into the elongated hole 22e opened near the engaging portion 22a. The upper surface of the distal end serves as a sliding surface 22g along which sliding point 16b of slider 16 can slide. In this embodiment, only one projection 16a is formed at the center of slider 16 so as to meet the single sliding surface 22g of change-over plate 22.

The rest of the features of this embodiment are substantially the same as that of the first embodiment and therefore will not be explained.

Figure 10A:
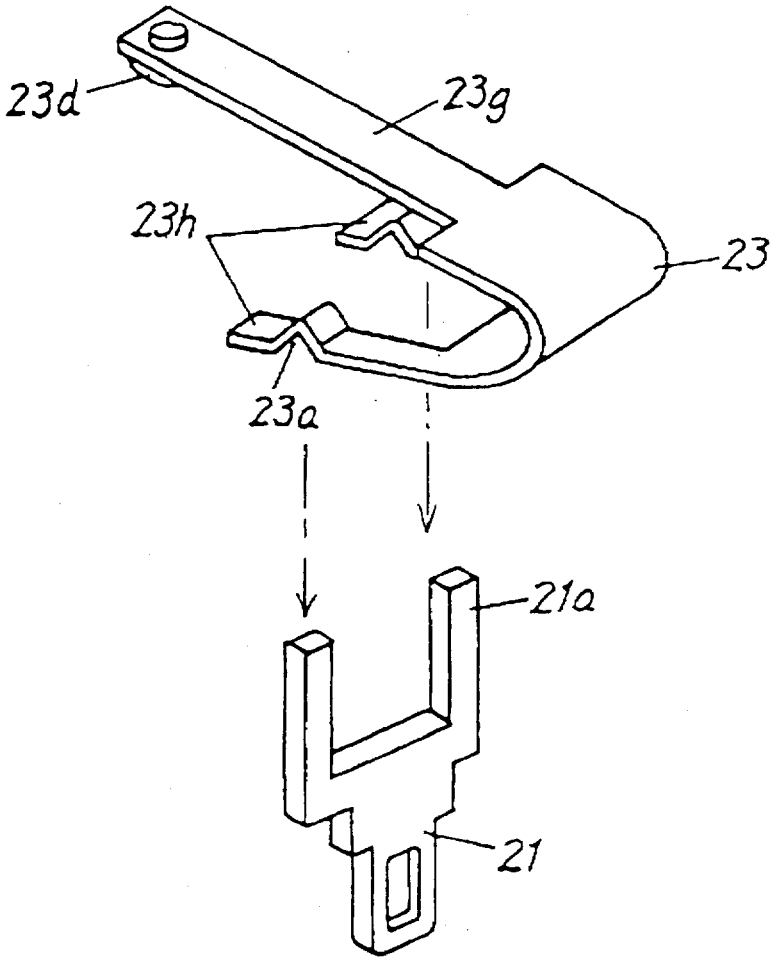
FIG. 10A is an exploded perspective view showing modification of the change-over plate and the common terminal in accordance with the fourth embodiment of the present invention.
Figure 10B:
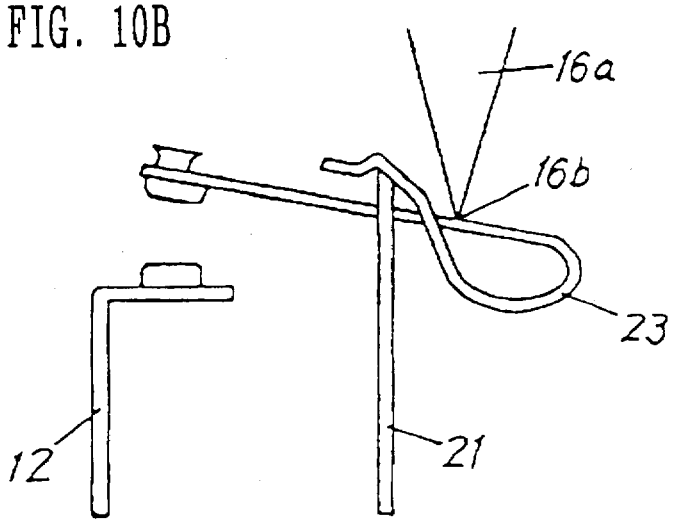
FIG. 10B is a front view showing the change-over plate and the common terminal of FIG. 10A.
Figure 11:
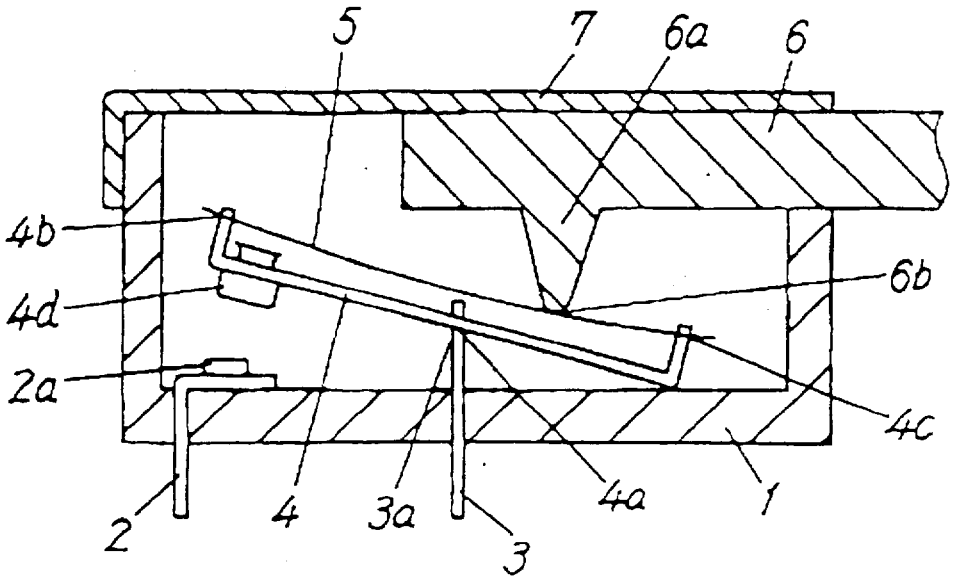
FIG. 11 PRIOR ART
FIG. 11 is a cross-sectional view showing an essential arrangement of a conventional switch.
Figure 12A:
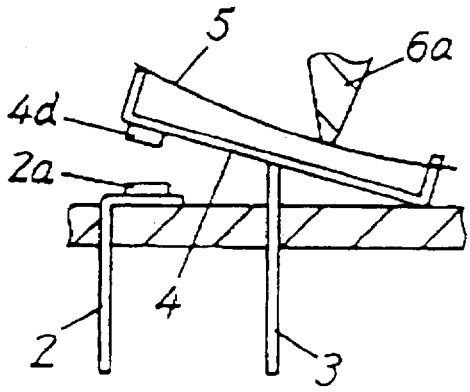
FIG. 12A PRIOR ART
FIGS. 12A and 12B are cross-sectional views cooperatively illustrating an operation of the conventional switch of FIG. 11.
Figure 12B:
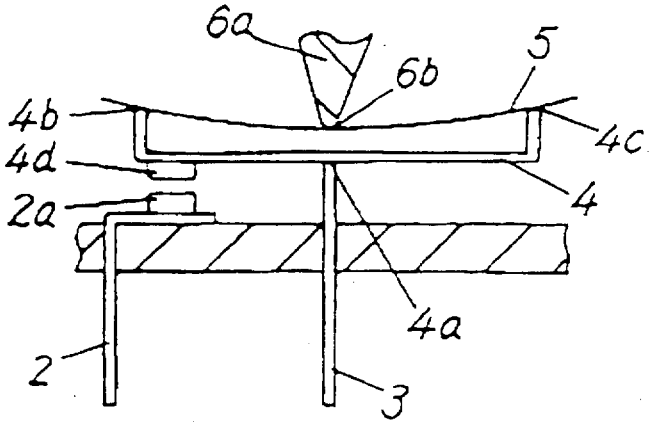
FIG. 12B PRIOR ART

FIG. 10A is an exploded perspective view showing a change-over plate 23 which is a modification of change-over plate 22 of the fourth embodiment of the present invention. And, FIG. 10B is a front view showing the change-over plate 23 and the common terminal 21 of FIG. 10A.

Change-over plate 23, made of a leaf spring, is configured into an U-shaped configuration. A contact 23d is fixed on one end of change-over plate 23. A pair of bifurcated legs 23*h* are formed on the other end of change-over plate 23. An engaging portion 23*a* is formed on the edge of each leg 23*h*. Engaging portion 23*a* is engageable with the upper end 21*a* of common terminal 21, so as to allow change-over plate 23 to cause a swing motion about the upper end 21*a* of common terminal 21.

A sliding surface 23*g*, extends from contact 23*d* to the opposite end, is resiliently deformable downward passing through a gap between two legs 23*h*. When protrusion 16*a* of slider 16 slides on the sliding surface 23*g* and passes the common terminal 21, contact point 16*b* of slider 16 is positioned at a position lower than the pivot (i.e. engaging portion 23*a*) of change-over plate 23.

As apparent from the foregoing description, the present invention provides a novel switch characterized in the positional relationship between the change-over plate and the slider, the positional relationship being quite different to that of the conventional switch. Due to the unique positional relationship between the change-over plate and the sldier in accordance with the present invention, the switching speed of change-over plate is greatly increased, realizing a contact-quick-movement function (i.e. a function of quickly moving a contact in a switching operation of a micro switch etc.) which could not be achieved by the conventional switch. The present invention can prevent the contacts from being welded or worn when they are subjected to a large electric current, thereby obtaining high reliability.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A switch comprising:

an insulating case having a common terminal and a stationary terminal provided on a bottom thereof, said common terminal having a recessed pivot on an upper end thereof and said stationary terminal having a contact;

a change-over plate having a sliding surface and an engaging portion engaged with said pivot of said common terminal, disposed such that said engaging portion is positioned further from said bottom of said insulating case than at least a portion of said sliding surface, said change-over plate being rotatable about said pivot of said common terminal;

a slider having a projecting slide portion brought into contact with said sliding surface of said change-over plate, disposed such that said slider can slide along said sliding surface; and a frame covering an upper opening of said insulating case to accommodate said change-over plate and said slider therein, wherein said projecting slide portion of said slider is always positioned below said engaging portion of said change-over plate, and said change-over plate is rotated about said pivot of said common terminal when said slider slides along said sliding surface, bringing a contact provided on one end of said change-over plate into contact with said contact of said stationary terminal.

2. The switch defined in accordance with claim 1, wherein said change-over plate comprises a resilient metallic member, and said engaging portion comprises a tonguelet provided at a center of said change-over plate, and a distal end of said tonguelet is engaged with and rotatable about said recessed pivot provided on the upper end of said common terminal.

3. The switch defined in accordance with claim 2, wherein said change-over plate comprises a bottom and two side walls forming a rectangular cross section, and said tonguelet extends between two parallel sliding surfaces elongated along upper ends of said two side walls.

4. The switch defined in accordance with claim 1, wherein said sliding surface provided on said change-over plate comprises at least one of a flat portion, an inclined portion and a curved portion.

5. The switch defined in accordance with claim 1, wherein said change-over plate comprises a leaf spring, said engaging portion is formed at a middle of said change-over plate to be engageable with and rotatable about said upper end of said common terminal, said change-over plate defines a hole at a center thereof, one end of said change-over plate is folded in a U-shaped configuration so that a distal end thereof is inserted into said hole, and an upper surface of said distal end serves as said sliding surface.

6. The switch defined in accordance with claim 1, wherein said change-over plate comprises a leaf spring and is folded in a U-shaped configuration, a contact is fixed on one end of said change-over plate, and the other end of said change-over plate is engaged with and rotatable about said upper end of said common terminal.

7. A switch comprising:

an insulating case having a common terminal and a stationary terminal provided on a bottom thereof, said common terminal having a recessed pivot on an upper end thereof and said stationary terminal having a contact;

a change-over plate having a sliding surface and an engaging portion engaged with said pivot of said common terminal, disposed such that said engaging portion is positioned further from said bottom of said insulating case than at least a portion of said sliding surface, said change-over plate being rotatable about said pivot of said common terminal;

a slider having a projecting slide portion brought into contact with said flat sliding surface of said change-over plate, disposed such that said slider can slide along said sliding surface; and a frame covering an upper opening of said insulating case to accommodate said change-over plate and said slider therein, wherein said change-over plate is rotated about said pivot of said common terminal when said slider slides along said sliding surface, bringing a contact provided on one end of said change-over plate into contact with said contact of said stationary terminal, wherein said change-over plate comprises a resilient metallic member, and said engaging portion comprises a tonguelet provided at a center of said change-over plate, and a distal end of said tonguelet is engaged with and rotatable about said recessed pivot provided on the upper end of said common terminal, and wherein said change-over plate comprises a bottom and two side walls forming a rectangular cross section, and said tonguelet extends between two parallel sliding surfaces elongated along upper ends of said tow side walls.

8. A switch comprising:

an insulating case having a common terminal and a stationary terminal provided on a bottom thereof, said common terminal having a recessed pivot on an upper end thereof and said stationary terminal having a contact;

a change-over plate having a sliding surface and an engaging portion engaged with said pivot of said common terminal, disposed such that said engaging portion is positioned further from said bottom of said insulating case than at least a portion of said sliding surface, said change-over plate being rotatable about said pivot of said common terminal;

a slider having a projecting slide portion brought into contact with said flat sliding surface of said change-over plate, disposed such that said slider can slide along said sliding surface; and a frame covering an upper opening of said insulating case to accommodate said change-over plate and said slider therein, wherein said change-over plate is rotated about said pivot of said common terminal when said slider slides along said sliding surface, bringing a contact provided on one end of said change-over plate into contact with said contact of said stationary terminal, and wherein said change-over plate comprises a leaf spring, said engaging portion is formed at a middle portion of said change-over plate to be engageable with and rotatable about said upper end of said common terminal, said change-over plate defines a hole at a center thereof, one end of said change-over plate is folded in a U-shaped configuration so that a distal end thereof is inserted into said hole, and an upper surface of said distal end serves as said sliding surface.

* * * * *